US006546856B2

(12) United States Patent
Tóth

(10) Patent No.: US 6,546,856 B2
(45) Date of Patent: Apr. 15, 2003

(54) SAFE AND ENVIRONMENT FRIENDLY PRESS

(76) Inventor: József Tóth, Andor Utca 92, Miskolc (HU), H-3532

( * ) Notice: Subject to any disclaimer, the term of this patent is extended or adjusted under 35 U.S.C. 154(b) by 0 days.

(21) Appl. No.: 09/964,570

(22) Filed: Sep. 28, 2001

(65) Prior Publication Data

US 2002/0014167 A1 Feb. 7, 2002

Related U.S. Application Data

(63) Continuation-in-part of application No. PCT/HU00/00027, filed on Mar. 29, 2000.

(30) Foreign Application Priority Data

Mar. 31, 1999 (HU) ..... P 9900829

(51) Int. Cl.[7] ..... B30B 15/28

(52) U.S. Cl. ..... 100/341; 100/43; 100/282; 100/291

(58) Field of Search ..... 100/43, 341, 48, 100/349, 282, 291, 226, 222

(56) References Cited

U.S. PATENT DOCUMENTS

| | | | | |
|---|---|---|---|---|
| 2,356,204 A | | 8/1944 | Birdsall | |
| 2,856,999 A | | 10/1958 | Wilhelm | |
| 3,662,640 A | * | 5/1972 | Wrona | 83/530 |
| 4,034,666 A | * | 7/1977 | Bigun et al. | 100/231 |
| 4,413,555 A | * | 11/1983 | Swinney | 100/214 |
| 4,827,839 A | | 5/1989 | Yonezawa et al. | |
| 4,952,270 A | * | 8/1990 | Sakaki et al. | 156/361 |
| 5,092,236 A | * | 3/1992 | Prim et al. | 100/220 |
| 5,271,318 A | * | 12/1993 | Lledos | 100/342 |
| 5,694,804 A | * | 12/1997 | Grabbe | 72/451 |
| 6,047,634 A | * | 4/2000 | Futsuhara et al. | 100/43 |

FOREIGN PATENT DOCUMENTS

| | | |
|---|---|---|
| CH | 359359 | 2/1962 |
| DE | 1 627 941 | 7/1971 |
| EP | 0 042 722 A1 | 12/1981 |
| EP | 0 673 707 A2 | 9/1995 |

* cited by examiner

*Primary Examiner*—William Hong
(74) *Attorney, Agent, or Firm*—Young & Thompson

(57) ABSTRACT

A pressing machine, particularly a fast operating pressing machine equipped with a pressing head forced into longitudinal jigging motion in a working range over a bench (46) by an eccenter disk (8), having an eccentric shaft, through a crank arm (9). The pressing head (12) has a lower pressing block (13) removable from the work range above the bench (46) and an upper pressing block (14) arranged slideably in relation to the lower and forced into jigging motion by the crank arm (9) and there is a connecting element (15) joining the lower pressing block (13) to the upper pressing block (14). The connection between the upper and lower pressing block (14, 13) can be broken, thereby motion of the lower pressing block (13) can be stopped while the eccentric disk (8), its shaft and any flywheel or similar inertial mass connected with the upper pressing block (14) continues to rotate. Preferably, said lower pressing block (13) has a suspension point (17), and a stop (26) impacting onto the upper dead point position of the jigging motion of the upper pressing block (14), as well as a suspending element (18) connected to the suspension point (17), cast through reels (19 and 20) and strained by a counterweight (21).

5 Claims, 3 Drawing Sheets

SAFE AND ENVIRONMENT FRIENDLY PRESS

Figure 1:
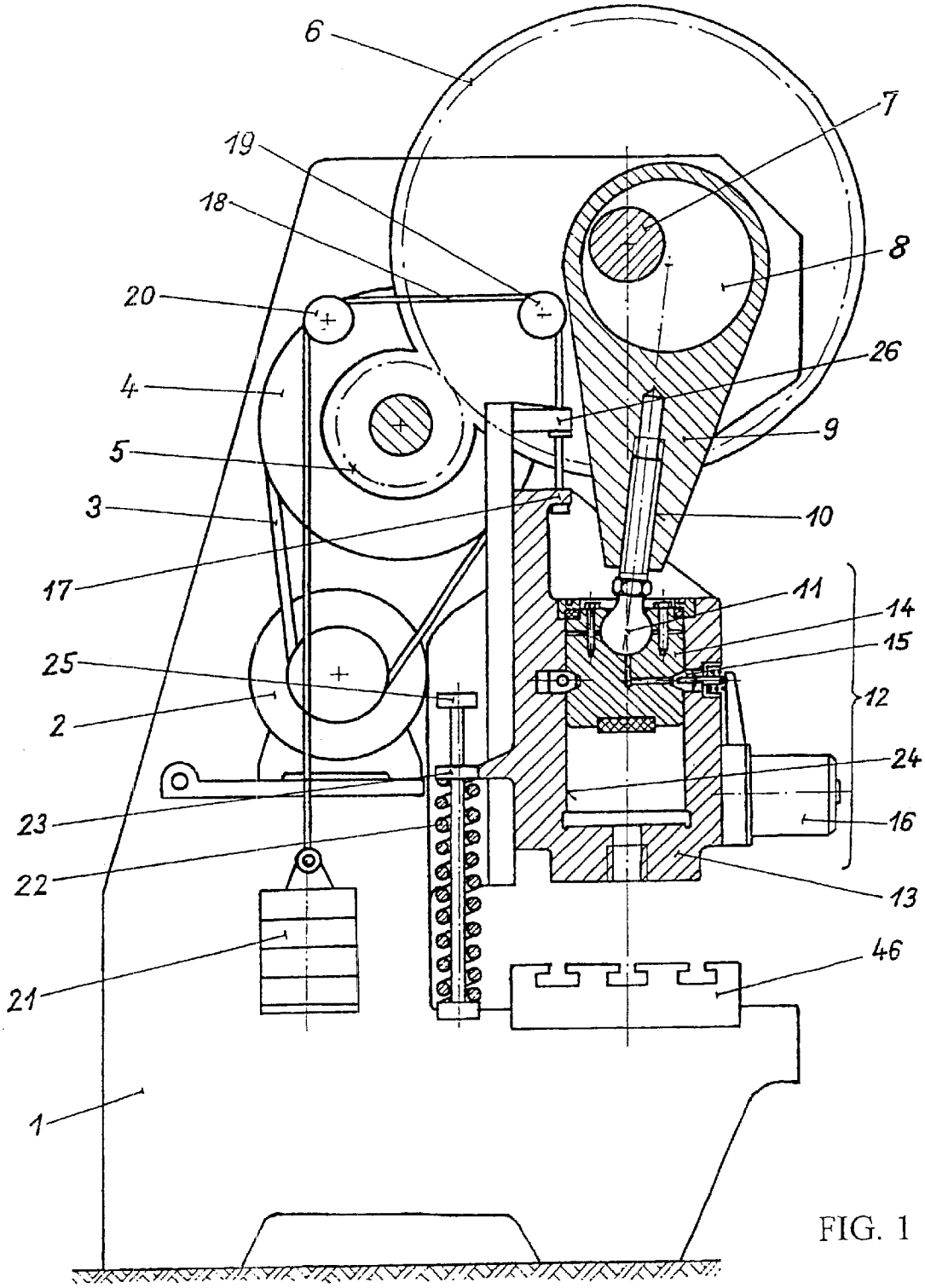

This is a continuation-in-part of international application PCT/HU00/00027, filed on Mar. 29, 2000.

The subject of the invention is a further development of press machines, principally fast eccentric press machines for increased human safety and reduced pollution of the environment, i.e., the atmosphere.

Fast, mechanically operated eccentric press machines have been used for a long time in the different areas of industry, e.g. mintage, coining, sheet forming, punching, etc. In the use of these machines, as a consequence of the fast operation, great care must be taken to ensure the safety of the person handling the machine.

In the case of the mechanically switched, so-called rotary bolt lock types used earlier, the pressing motion could only be turned off and on at a single point of the machine's stroke. Therefore if the hand of the operator got into the working range—in the absence of the possibility of turning the press off—it was unavoidably fractured by the machine. To prevent it, the so called two-hands starter was used, where the operator had to operate simultaneously two separate trip-levers with the two hands to turn on the stroke of the pressing machine. This solution however slowed down considerably the operation of the machine making impossible to utilise its advantage: the fast operation; thus, the number of pieces pressed per hour remained at a very low value. The operating personnel—paid at piece wage—tried to inactivate the two-hand starter, resulting in serious injuries, hand amputations. For this reason the rotary bolt machines were banned in most of the countries, although they were very simply built and operated very reliably.

To replace the banned machines, the more complex and rather more expensive machines with sliding sheet clutch were used, which could be turned off and on at any point of the pressing stroke movement. Should a person's hand get into the working range, this could for instance be sensed, and the machine stopped with fast breaking by a photocell. Problems rose however with this type of machines too.

One of the problems is that although large, over dimensioned friction clutch was built into the pressing machine, it took 3–5 seconds to arrest the large rotating and jigging mass in motion, and during that time the fast pressing motion could just crush the members or other alien parts that got into the working range.

The other problem is that significant quantities of oil vapour are produced during the operation of the large friction clutch polluting the air of the workshop. Oil vapours of the atmosphere may cause infection of the respiratory tract and cancer of the lung.

The aim of the present study is the further development of the earlier, mechanically activated press through electrification so as to ensure faster stopping and thus safer operation than that of the known solutions, and preventing at the same time the pollution of the plant's atmosphere with oil vapours.

The invention stemmed from the discovery, that it is not necessary to arrest the rotating and jigging mass of the pressing machine to avoid accidents, as the accident is caused exclusively by the upper and lower parts of the press-head working in the work range. That is in case of danger it is sufficient to separate the two parts of the press-head by a fast electrically switched releasing action, thereby arresting the lower part of the press-head and removing it from the work range. The effective speef of the electric switching action is improved by arranging an electromagnet for releasing engagement between the upper and lower part of the press-head directly on the press-head.

Therefore the aim of the invention is to construct pressing machines, principally fast pressing machines with pressing heads forced into longitudinal jigging and oscillating motion through crank arm by eccentric axle eccentric disk featuring a press-head having a lower pressing block removable from the work range located over the bench, and an upper pressing block capable of sliding relative to the lower pressing block and forced into a jigging motion by the crank, and having alongside an element joining the lower pressing block to the upper one.

The aim set is achieved by a pressing machine, particularly a fast operating pressing machine equipped with a pressing head forced into longitudinal jigging motion in a working range over a bench by an eccenter disk, having an eccentric shaft, through a crank arm, said pressing head having a lower pressing block removable from the work range above the bench and an upper pressing block arranged slideably in relation to the lower pressing block and forced into jigging motion by the crank arm. There is a connecting element releasably connecting said lower pressing block to the upper pressing block; said lower pressing block having at least one of a suspension point and a lifting point; a suspending element is connected to said suspension point, suspending element is cast through reels and strained by a counterweight and a stop impacting onto the upper dead point position of the jigging motion of the upper pressing block. Said lifting point being elevated by a cylindrical spring and a backstop impacting onto the upper dead point position of the jigging motion of the upper pressing block.

The invented pressing machine features a pressing head having an electromagnet for operating said connecting element between a connecting position, wherein the lower pressing block is fastened to the upper pressing block, and a released position, wherein said lower pressing block can freely slide in relation to said upper pressing block. Thereby the connection between the upper and lower pressing block can be broken, thereby motion of the lower pressing block can be stopped while the eccentric disk, its shaft and any flywheel or similar inertial mass connected with the upper pressing block continues to rotate.

Figure 2:
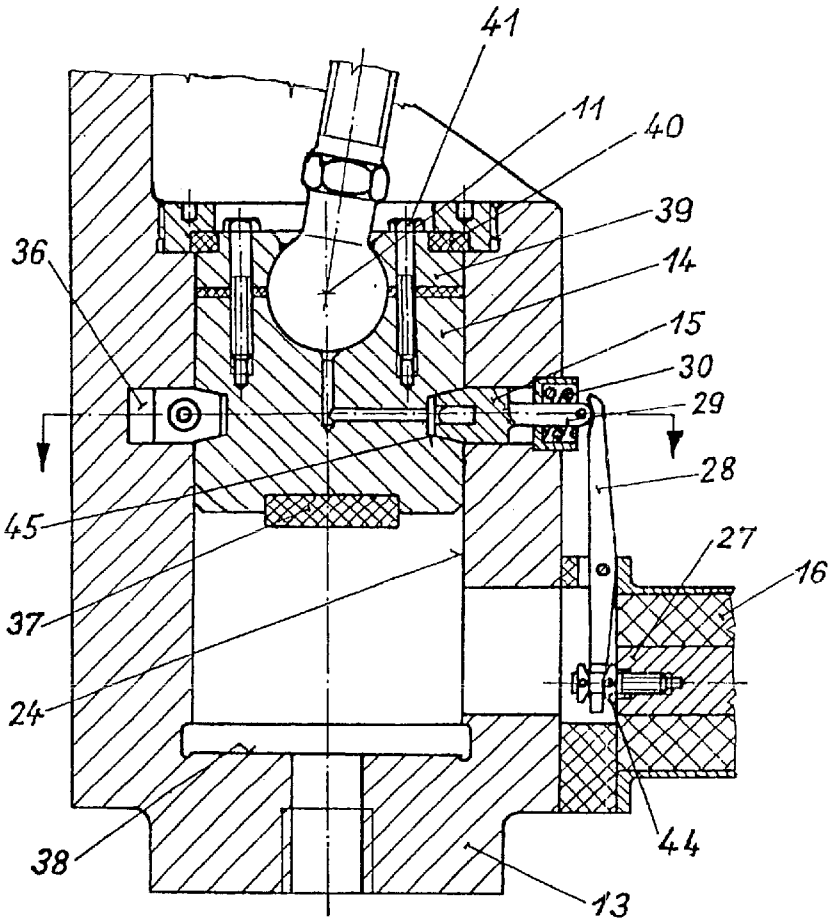
Figure 3:
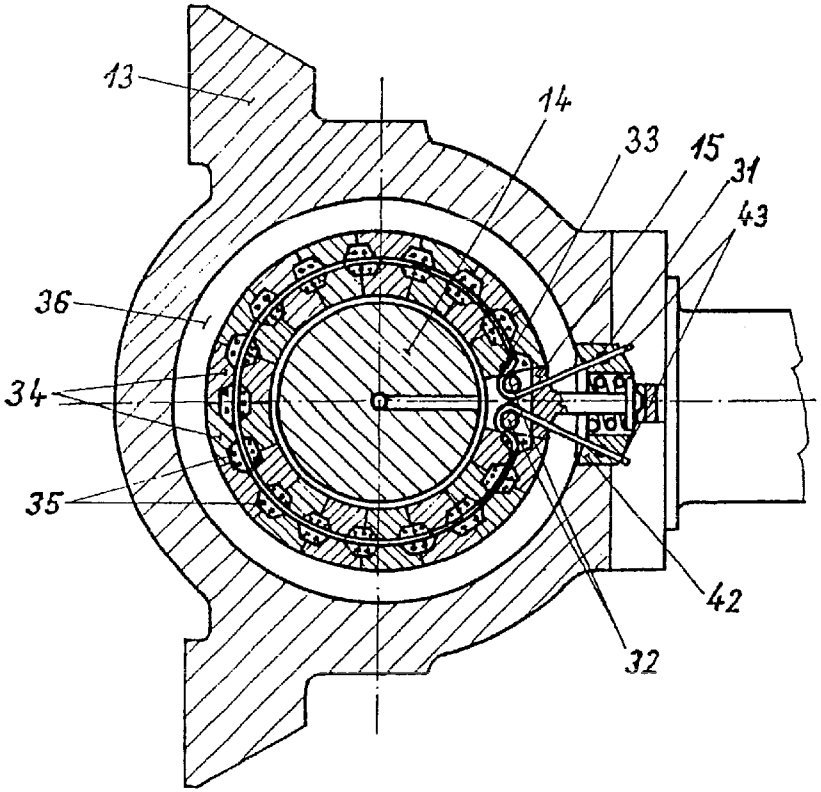
Figure 4:
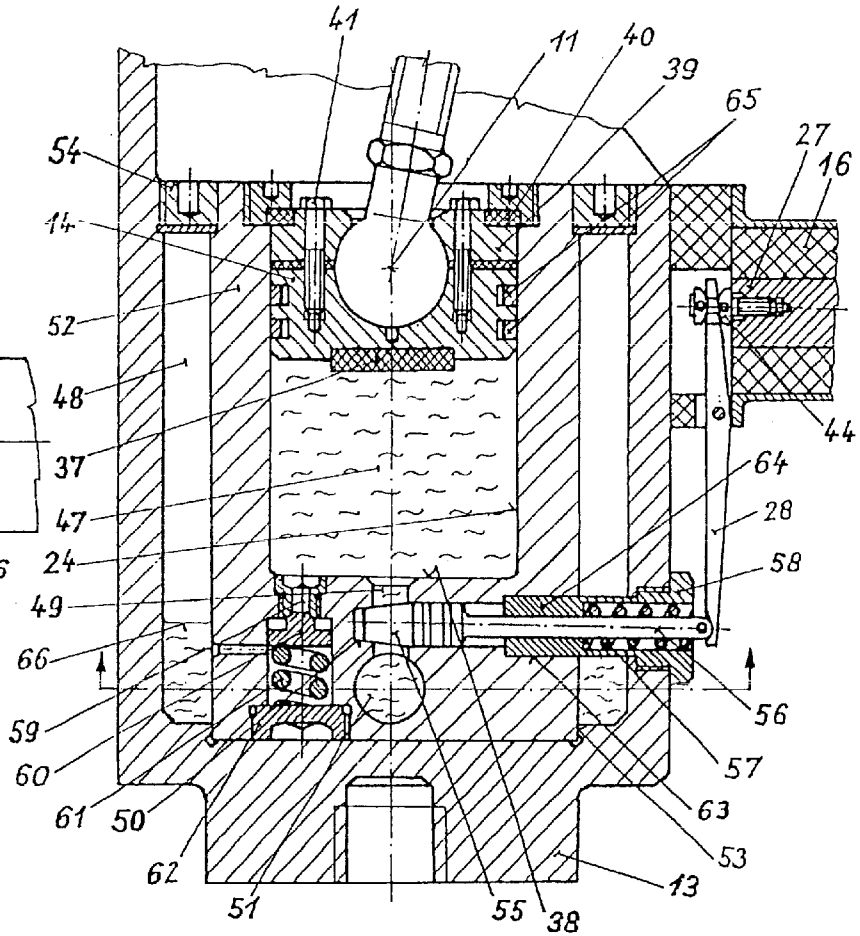
Figure 5:
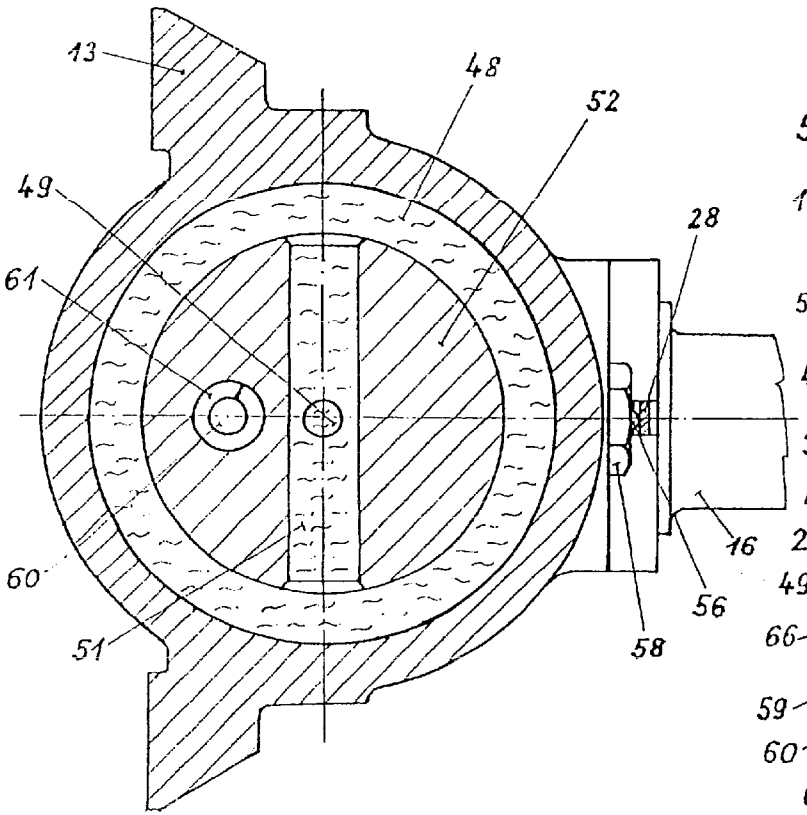

Further aims, features and advantages of the invention and two possible embodiments are detailed hereinbelow with reference to the attached drawings, wherein FIG. 1 shows the structure of a first embodiment of a pressing machine according to the invention, FIG. 2 shows a longitudinal section of a possible configuration of the pressing head of the pressing machine according to the invention, FIG. 3 shows a cross section of the same pressing head, FIG. 4 shows a longitudinal section of another possible configuration of the pressing head of the pressing machine according to the invention FIG. 5 shows a cross section of this variant of the pressing head.

The operation and construction of the machine is described with reference to the drawings.

An electric motor 2 located in a framework 1 drives a flywheel 4 through a V-belt 3. A flywheel 4 is coupled through a cogwheel 5, integral therewith, to a cogwheel 6, which rotates a shaft 7 equipped with an eccentric disk 8. This eccentric disk 8 forces a pressing head 12 into a jigging or alternating motion via a crank 9 through a ball head 11 of a screw spindle 10. A cylindrical cavity 24 is formed in the interior of a lower pressing block 13 of the pressing head 12. An upper pressing block 14 of the pressing head 12 is slidingly located in the cylindrical cavity 24 and is directly connected to the ball head 11 of the screwed spindle 10. During the working stroke the lower pressing block 13 and the upper pressing block 14 of the pressing head 12 are joined through a connecting element 15 and forced into jogging motion transmitted by the crank 9. The turned on or engaged condition of the connecting element 15 is caused by the attracted or active pulling condition of an electromagnet 16.

However, if the electromagnet 16 releases connecting element 15 disconnects and the upper pressing block can slide into the cylindrical cavity 24 of the lower pressing block 13. At this stage a suspending element 18 cast around reels 19 and 20 under the action of a counter weight 21 will lift the lower pressing block 13 via a suspension point 17 from the work range over a bench 46. The suspending element 18 should be made preferably of stranded steel wire.

The lifting out of the lower pressing block 13 from the work range can result not only from the effect of counter weight 21, but also from the effect of the lifting force exercised by the cylindrical spring 22 onto a lifting point 23.

The lower pressing block 13 of the pressing head 12 can be lifted from the bench 46 either by the suspending element 18 or the cylindrical spring separately or the combination of the two. The important in either method is that the lifting motion must stop when the connecting element 15 moving in conjunction with the lower pressing block 13 reaches the upper dead point position of the upper pressing block's 14 jigging motion. This stopping at the upper dead point is caused by the motion of suspension point 17 bumping against a limiting stop 26 and the lifting point 23 meeting the backstop 25. Through this measures it is possible to ensure that the connecting element 15 connects the upper pressing block 14 to the lower pressing block 13 at the upper dead point position without any shock.

The pressing head is shown in FIG. 2 shows in an enlarged longitudinal section and in FIG. 3 the cross section of this configuration is shown. When an iron core 27 of electromagnet 16 attracts a bent-lever 28 connected to the iron core 27 with a screw 44 pushes the connecting element 15 onto a conical cavity 45 of the upper pressing block 14 through a cylindrical rod 29 against a cylindrical spring 30. At the same time the connecting element 15 is pushed onto the conical cavity 45, the two reels 32 tighten a Bowden-cable 33 fastened to a fastening plug 42 at its two ends 43 with a screw 31, and as a result, also circumpositioned claws 34 are pushed into the conical cavity 45. The connecting element 15 and the claws 34 encircle fully the upper pressing block 14 and fasten it to the lower pressing block 13.

However if the iron core 27 of the electromagnet 16 releases a bent-lever 28 drops back and the cylindrical spring 30 pulls out the connecting element 15 from the conical cavity 45 of the upper pressing block 14 through the cylindrical rod 29. At the same time the Bowden-cable becomes slack and cylindrical springs 35 move the claws away from each-other, which, pushed out of the conical cavity 45 of the upper pressing block 14 retract into the cylindrical cavity of the lower pressing block. At this stage the mechanical connection between the upper pressing block and lower pressing block brakes. As a result, the upper pressing block 14 can freely slide into the cylindrical cavity 24 of the lower pressing block 13 and the movement of the pressing head 12 part: the lower pressing block is lifted out of the work range over bench 46, while the upper pressing block 14 performs the jigging motion forced by the crank 9 through the ball-head 11 of the screwed spindle. In order to prevent a metallic collision between the upper pressing block 14 sliding up and down in the cylindrical cavity 24 and the lower pressing block 13 at the end positions of the jigging motion, there is a built in plastic disk 37 from the lower direction and a plastic ring 40 from above. The danger of possible end position collisions is reduced by the plastic disk 37 fixed to the upper pressing block touching a bottom surface 38 of a cylindrical cavity 24, and a plastic ring 40 touching a binding ring 39 clamping the ball-head 11 of the upper pressing block 14 with screws 41. In this respect it should be mentioned, that the dampening of the collisions described above serves as a secondary safety precaution, since if the adjustment of the backstop 25 and stop 26 is correct no end position collision can occur.

For the version of the invention described above it is an important construction feature that the surface of both the connecting element 15 and the claws 34 is slanted and the angle of the slope is identical to the bevel-angle of the conical cavity 45 of the upper pressing block 14. This angle of slope and bevel-angle are set just within the range of self-closing range at 8° to 13° with the result that the connecting element 15 and the claws 35 are easily pulled out from the conical cavity 45 of the upper pressing block during operation, that is, the movement of the pressing head 12 can easily be parted at all unloaded sections of the machine's stroke. Turning on however is only possible at the upper dead point position, where the upper pressing block 14 and lower pressing block 13 of the pressing head 12 can be connected. That is, in this version, the pressing movement of the machine can be turned off at any place along the unloaded stroke, but it can only be turned on at the upper dead point position.

The result of the angle of slope and bevel angle close to the self-closing limit is that in case of overloading the actual angle of slop and bevel-angle exceed the self-closing limit due to the connecting element 15 and claws 34 falling flexibly into the cylindrical cavity 36 of the lower pressing block 13 and the upper pressing block 14 and the lower pressing block 13 of the pressing head 12 disconnect automatically. That is, this feature provides an overload protection too for the machine.

The longitudinal section of another possible embodiment of the pressing head 12 is shown in FIG. 4, the cross section in FIG. 5.

In this construction the movement of the lower pressing block 13 and the upper pressing block 14 is connected by a hydraulic medium 47 (preferably hydraulic oil) in the cylindrical cavity 24. A pot 52 shaped body is fastened to a seat 53 of the lower pressing block 13 with the aid of an annular screw 54, and the upper pressing block 14 sealed with sealing rings 65 penetrates its cylindrical cavity 24 filled with said hydraulic medium 47. If an outflow bore 49 of the pot 52 shaped body is closed by a conical valve 55 the hydraulic medium 47 can not flow out of the cylindrical cavity and the jigging motion of the upper pressing block 14 will be transferred to the lower pressing block 13 through the pot 52 shaped body. The attraction of the iron core 27 of the electromagnet 16 will push the conical valve 55 through a cylindrical shaft 56 and bent-lever 28 onto the conical bore 50 of the pot 52 shaped body.

If the electromagnet 16 drops a spring 57 will pull out the conical valve 55 from the conical bore 50 and the hydraulic medium 47 will flow out of the cylindrical cavity 24 through the cylindrical cavity 51 onto an enclosed annular 48 space. At this stage, depending on the quantity of the out-flowing hydraulic medium 47, the upper pressing block 14 will be pushed onto the cylindrical cavity 24, that is, the lower pressing block 13 will be lifted out of the work range over bench 46 by the lifting force (that is the counter weight 21 and/or the pressing force of the cylindrical spring 22).

If the conical valve 55 remains open for a longer period, the hydraulic medium 47 will flow out from the cylindrical cavity 24 onto the enclosed space 48, from where, propelled by the atmospheric pressure in the anchor-ring 48 shaped enclosed space will flow back onto the cylindrical cavity 24. That is, at that stage the lower pressing block 13 is at the upper dead point position, while the upper pressing block 14 is jigging up and down in the cylindrical cavity 24. If the electromagnet 16 attracts, however the outflow bore 49 closes and the enclosed hydraulic medium 47 connects the movement of the upper pressing block 14 and the lower pressing block 13. It is apparent that in this configuration the conical valve 55 can be opened or closed at any point of the stroke, that is emergency stopping can occur anywhere, and the work jigging can be turned on anywhere and can be regulated from 0 to the full length of the stroke.

The cylindrical stoke 56 of the conical valve 55 fits slidingly into the cylindrical socket 64, and the cylindrical socket 64 fits into the cylindrical bore-hole of the pot 52 shaped body, that is, there is a double cylindrical fitting protecting against the leakage of the hydraulic medium 47. In spite of this measure, the hydraulic medium that escaped must be replaced from time tot time (every 1–2 year) after the inspection of the stagnant oil level 66.

This configuration too can be equipped with the overload protection of the pressing machine. This can be achieved with the safety valve 59 sunk into the bottom surface 38 of the cylindrical cavity 24, closed by a valve plate 60 shut-off by the screwed plug 62, strained by the spring 61.

The invention concerns not only the pressing machines on the drawings, but to other pressing machines as well. Thus for instance, the two parts of the pressing head can be turned by way of pneumatic solutions, or for instance the pressing head can be removed from the work range by pneumatic air spring.

The advantageous properties of the pressing machine can be summarised as follows. In the case of an emergency stopping, the breaking distance of the pressing head, the main source of accidents, is zero and therefore the time delay of the emergency stop will only be characterised by the switch-ver delay of the electromagnet operating the switch. Both the turning in and the turning off of the press motion allow a shock-free, noiseless operation. No oil vapour is produced during the operation of the pressing machine. The switching device that shortens the breaking distance at the switching off switches off automatically in case of overload and protects the machine against breaking.

The configuration of the invention using hydraulic medium units the fast operation of the mechanic, eccentric pressing machines with the smooth, vibration free operation of the hydraulic pressing machines.

What is claimed is:

1. A pressing machine, particularly a fast operating pressing machine equipped with a pressing head forced into longitudinal jigging motion by an eccentric disk, having an eccentric shaft, through a crank arm, said pressing head (12) having a lower pressing block (13) removable from the work range above the bench (46) and an upper pressing block (14) arranged slideably in relation to the lower pressing block (13) and forced into jigging motion by the crank arm (9) and there is a connecting element (15) releasably connecting said lower pressing block (13) to the upper pressing block (14); said lower pressing block (13) having at least one of a suspension point (17) and a lifting point (23); a suspending element (18) is connected to said suspension point (17), suspending element (18) is cast through reels (19 and 20) and strained by a counterweight (21) and a stop (26) impacting onto the upper dead point position of the jigging motion of the upper pressing block (14); said lifting point (23) being elevated by a cylindrical spring (22) and a backstop (25) impacting onto the upper dead point position of the jigging motion of the upper pressing block (14), characterised by having an electromagnet (16) for operating said connecting element between a connecting position, wherein the lower pressing block (13) is fastened to the upper pressing block (14), and a released position, wherein said lower pressing block (13) can freely slide in relation to said upper pressing block (14).

2. The pressing machine as claimed in claim 1 characterised in that said electromagnet (16) operating said connecting element (15) is mounted directly to said lower pressing block (13) of said pressing head (12).

3. The pressing machine as claimed in claim 1 characterised in that its connecting element (15) having two reels (32) with the Bowden cable (33) passing across and fastened to the fastening plug (42) at the two ends (43) with the screws (31), and with the Bowden cable (33) encircling the conical cavity (45) formed in the upper pressing block (14), alongside witch there are pitched claws (34) threaded on the Bowden cable (33) in the conical cavity (45) and there are also cylindrical springs (35) threaded onto the Bowden cable (33) in the space of the connecting claws (34).

4. The pressing machine as claimed in claim 1 characterised in that said connecting element (15) has a conical valve (55) suitable for closing a cylindrical cavity (51) connecting a cavity (24) and ring shaped chamber (48) of said lower pressing block (13) with each other.

5. The pressing machine as claimed in any of claim 2, characterized in that said connecting element (15) is connected to said electromagnet (16) through a bent lever (28).

* * * * *